US010189069B1

(12) United States Patent
Huang

(10) Patent No.: US 10,189,069 B1
(45) Date of Patent: Jan. 29, 2019

(54) PORTABLE TUBE BENDER

(71) Applicant: YUNG CHI INDUSTRY CO., LTD., Taichung (TW)

(72) Inventor: Wu-Sheng Huang, Taichung (TW)

(73) Assignee: Yung Chi Industry Co., Ltd., Taichung (TW)

( * ) Notice: Subject to any disclaimer, the term of this patent is extended or adjusted under 35 U.S.C. 154(b) by 0 days.

(21) Appl. No.: 15/794,441

(22) Filed: Oct. 26, 2017

(51) Int. Cl.
*B21D 7/06* (2006.01)
*B21D 7/022* (2006.01)
*B21D 7/14* (2006.01)

(52) U.S. Cl.
CPC ..... *B21D 7/063* (2013.01); *B21D 7/022* (2013.01); *B21D 7/06* (2013.01); *B21D 7/14* (2013.01)

(58) Field of Classification Search
CPC . B21D 7/04; B21D 7/06; B21D 7/022; B21D 7/063; B21D 7/14
USPC ..... 72/389.8, 389.9, 390.2
See application file for complete search history.

(56) References Cited

U.S. PATENT DOCUMENTS 3,124,192 A * 3/1964 Williams et al. ..... B21D 7/06 72/389.8
4,005,593 A * 2/1977 Goldberg ..... B21D 7/06 72/213
4,232,542 A * 11/1980 Caporusso ..... B21D 7/063 72/389.8
4,265,106 A * 5/1981 McMaster ..... B21D 7/06 72/389.8
5,761,950 A * 6/1998 Chiu ..... B21D 7/063 72/389.1
6,931,908 B1 * 8/2005 Mitson ..... B21D 7/04 72/213
D596,004 S * 7/2009 Picaza Ibarrondo ..... D8/32
9,144,835 B2 * 9/2015 Houle ..... B21D 7/063
9,162,273 B1 * 10/2015 Chiu ..... B21D 7/06
9,433,988 B1 * 9/2016 Huang ..... B21D 7/066

* cited by examiner

*Primary Examiner* — David B Jones
(74) *Attorney, Agent, or Firm* — Wang Law Firm, Inc.

(57) ABSTRACT

A tube bender includes a bending tool and a bending base connected to the bending tool. The bending tool has an arched member. The bending base has a first plate, a second plate, a first block, and a second block. The first plate is separated from the second plate to form a bending space therebetween. The first and the second blocks are received in the bending space and pivoted on both the first plate and the second plate. A tube is adapted to be rested on the first and the second blocks while the arched member is able to be moved toward the tube to bend the tube. The first block and the second block are rotated automatically according to a curvature of the tube being bent.

2 Claims, 9 Drawing Sheets

PORTABLE TUBE BENDER

BACKGROUND OF THE INVENTION

1. Technical Field

The present invention relates to a hand tool, and more particularly to a portable tube bender.

2. Description of Related Art

Typically, tube benders are applied to bend metallic tubes or pipes, such as transmission pipelines and refrigerant pipes for various machines. The conventional tube benders usually are huge, which makes the conventional tube benders take larger space and are hard to move.

A conventional tube bender includes a hydraulic device and a positioning holder. The hydraulic device has a liquid tank and a case communicated with the liquid tank. A first pole and a second pole are provided in the case and movably engaged with each other. The positioning holder is connected to the second pole. Such tube bender is smaller for a user to carry it.

Most conventional tube benders are provided with two support blocks to support the tube to be bent, and a movable member to be moved toward the tube to bend it. However, the support blocks each has a free end that makes the pin for pivoting the support blocks bending when the movable member is moved to bend the tube. After a time of use, the support blocks are tilted that makes the tube bender unable to bend the tube with a preset curvature.

BRIEF SUMMARY OF THE INVENTION

In view of the above, the primary objective of the present invention is to provide a tube bender, which bends a tube with a precise curvature.

The secondary objective of the present invention is to provide a tube bender, which has a strong structure to elongate the life of the tube bender.

In order to achieve the objective of the present invention, a tube bender includes a bending tool having an arched member, wherein the arched member has an arched slot; and a bending base connected to the bending tool, and having a first plate, a second plate, a first block, and a second block. The first plate is separated from the second plate to form a bending space therebetween. The first block and the second block are received in the bending space and pivoted on both the first plate and the second plates respectively. The first block is provided with a first groove, and the second block is provided with a second groove. Whereby a tube is adapted to be received in the first groove of the first block and the second groove of the second block, the arched member is able to be moved toward the tube to bend the tube, and the first block and the second block are rotated automatically according to a curvature of the tube.

The present invention further provides a bending base of a tube bender, including a first plate, a second plate, a first block, and a second block. The second plate is kept a predetermined distance from the first plate to form a bending space therebetween. The first block has a first groove, and is received in the bending space to be pivoted on the first and the second plate for free rotation. The second block has a second groove, and is received in the bending space to be pivoted on the first and the second plate for free rotation.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
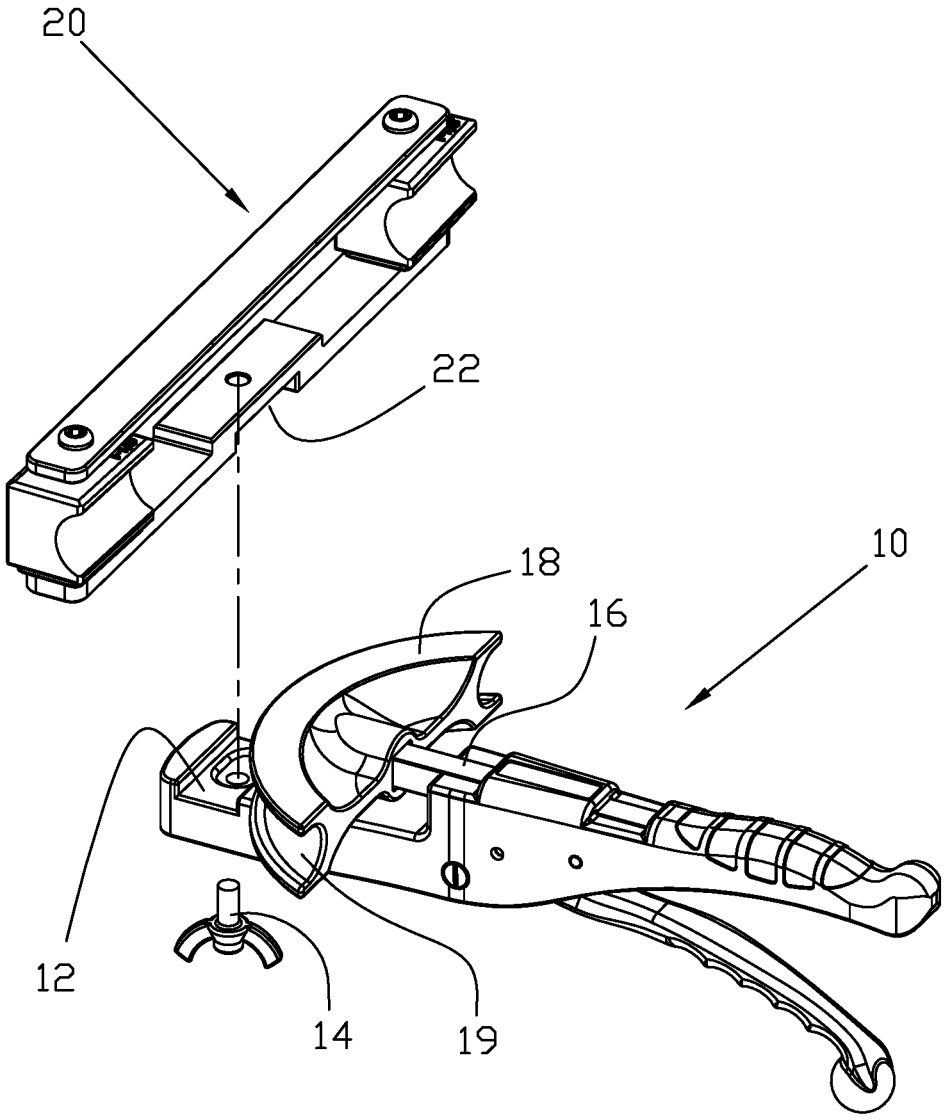
FIG. 1 is a sectional view of a first preferred embodiment of the present invention.
Figure 2:
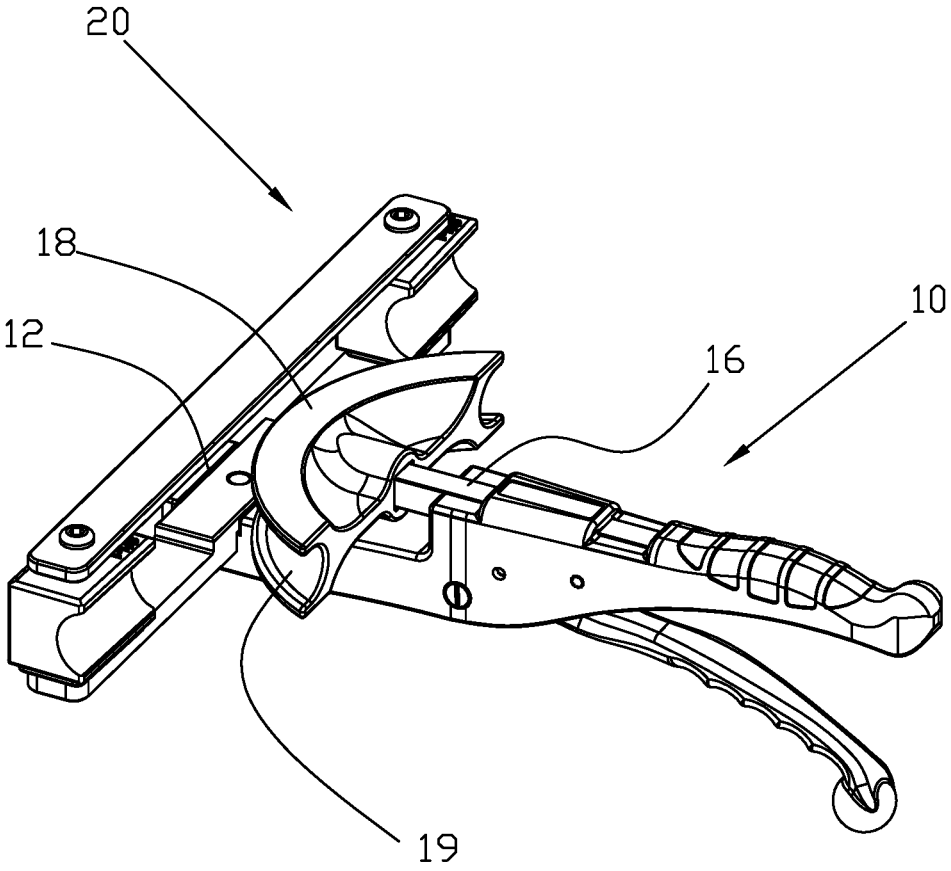
FIG. 2 is a perspective view of the first preferred embodiment of the present invention.

As shown in FIGS. 1 and 2, a tube bender of the first preferred embodiment of the present invention includes a bending tool 10 and a bending base 20. The bending tool 10 has a first slot 12 at an end thereof, and the bending base 20 has a second slot 22. The bending base 20 is connected to the bending tool 10 by the second slot 22 engaging the first slot 12. A positioning member 14 is inserted into the bending tool 10 and the bending base 20 at a position where the second slot 22 engages the first slot 12 to connect the bending tool 10 to the bending base 20.

The bending tool 10 has a rack 16 and an arched member 18 movably engaging the rack. The bending tool 10 is pivoted with a lever, which is connected to the rack 16. A user may operate the lever repeatedly to move the arched member 18 toward or away from the bending base 20 through the rack 16. The mechanism of driving the arched member 18 is well known technique in the conventional tube bender, so I don't describe the detail here. The arched member 18 has an arched slot 19 at a side facing the bending base 20.

Figure 3:
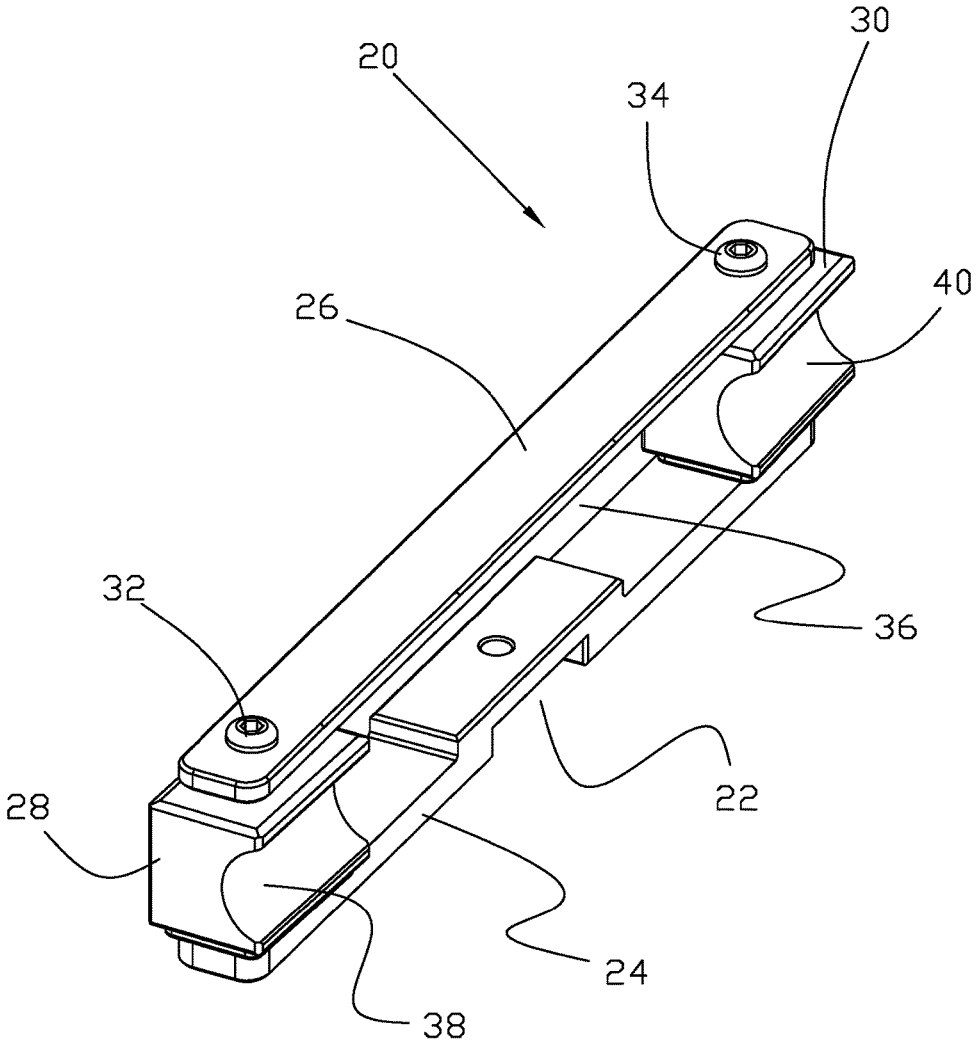
FIG. 3 is a perspective view of the bending base the first preferred embodiment of the present invention.

As shown in FIG. 3, the bending base 20 has a first plate 24 and, a second plate 26, a first block 28, and a second block 30. The first and the second plates are rectangular and parallel. The second slot 22 is formed on a bottom of the first plate 24.

The first and the second blocks 28 and 30 are kept a predetermined distance from each other with the first plate 24 attached to tops thereof and the second plate 26 attached to bottoms thereof. A first pin 32 passes through the first plate 24, the first block 28, and the second plate 26 in sequence to pivot the first block 28 on the first and the second plates 24 and 26. Likewise, a second pin 34 passes through the first plate 24, the second block 30, and the second plate 26 in sequence to pivot the second block 30 on the first and the second plates 24 and 26, so that the first and the second blocks 28 and 30 are able to rotate with centers of rotation of the first and the second pins 32 and 34.

A bending space 36 is formed between the first and the second plates 24 and 26 to receive both the first and the second blocks 28 and 30. The first block 28 is provided with a first groove 38, and the second block 30 is provided with a second groove 40.

Figure 4:
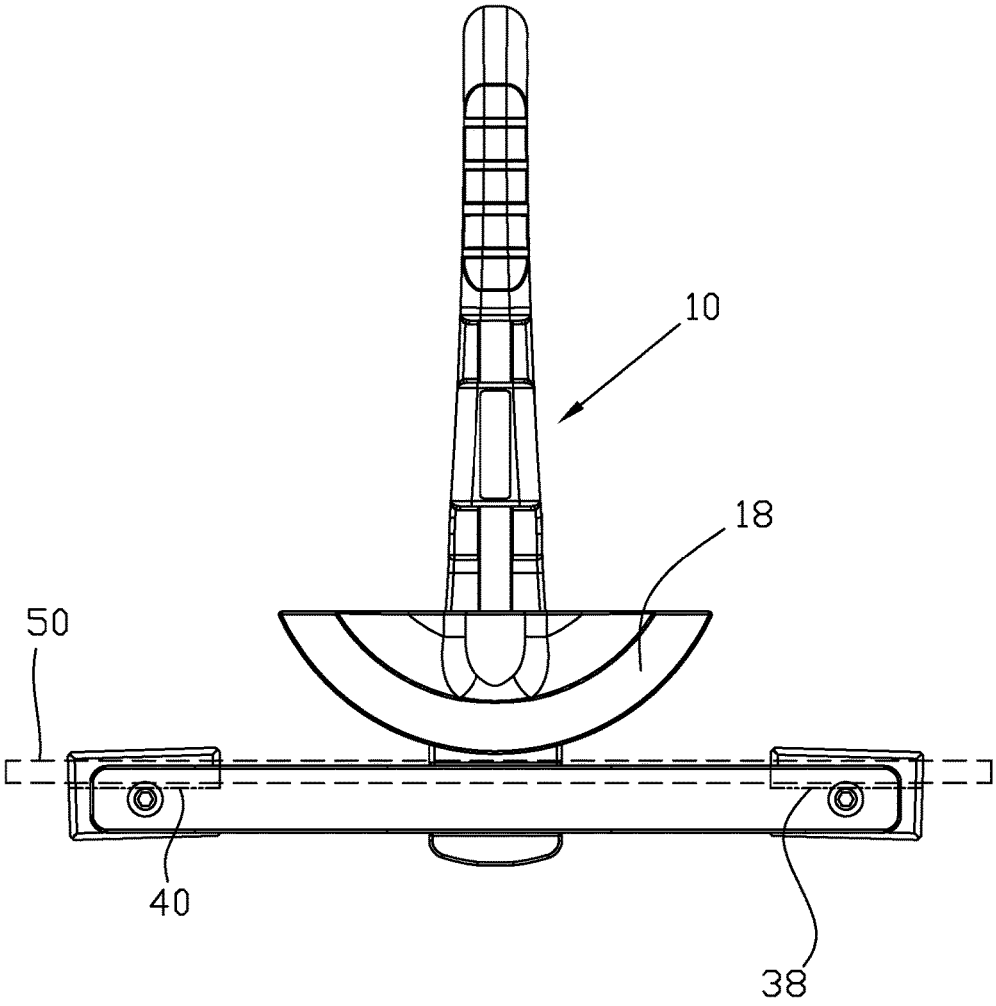
FIG. 4 to FIG. 6 are sketch diagram of the first preferred embodiment of the present invention, showing how to bend the tube.
Figure 5:
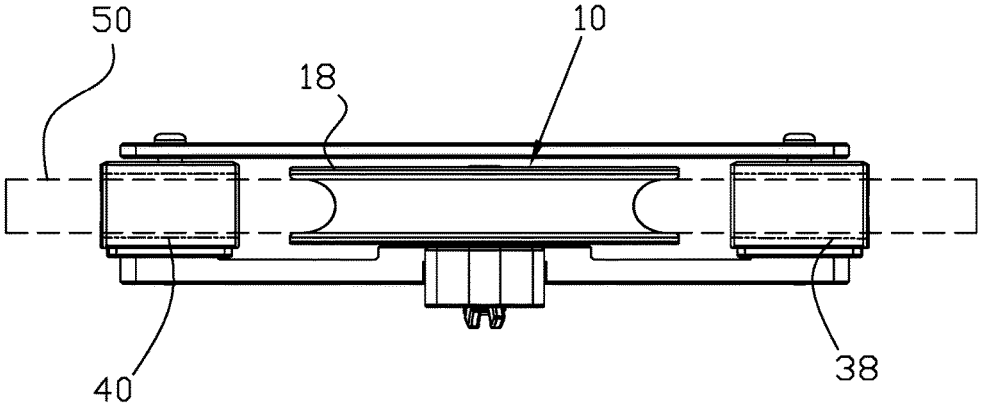

As shown in FIG. 4 and FIG. 5, a tube 50 is received in the first of the second grooves 38 and 40, and the arched member 18 is ready to be moved toward the tube 50. As a result, the tube 50 is bent by the arched member 18, and the first and the second blocks 28 and 30 are turned automatically according to a curvature of the tube 50.

Figure 6:
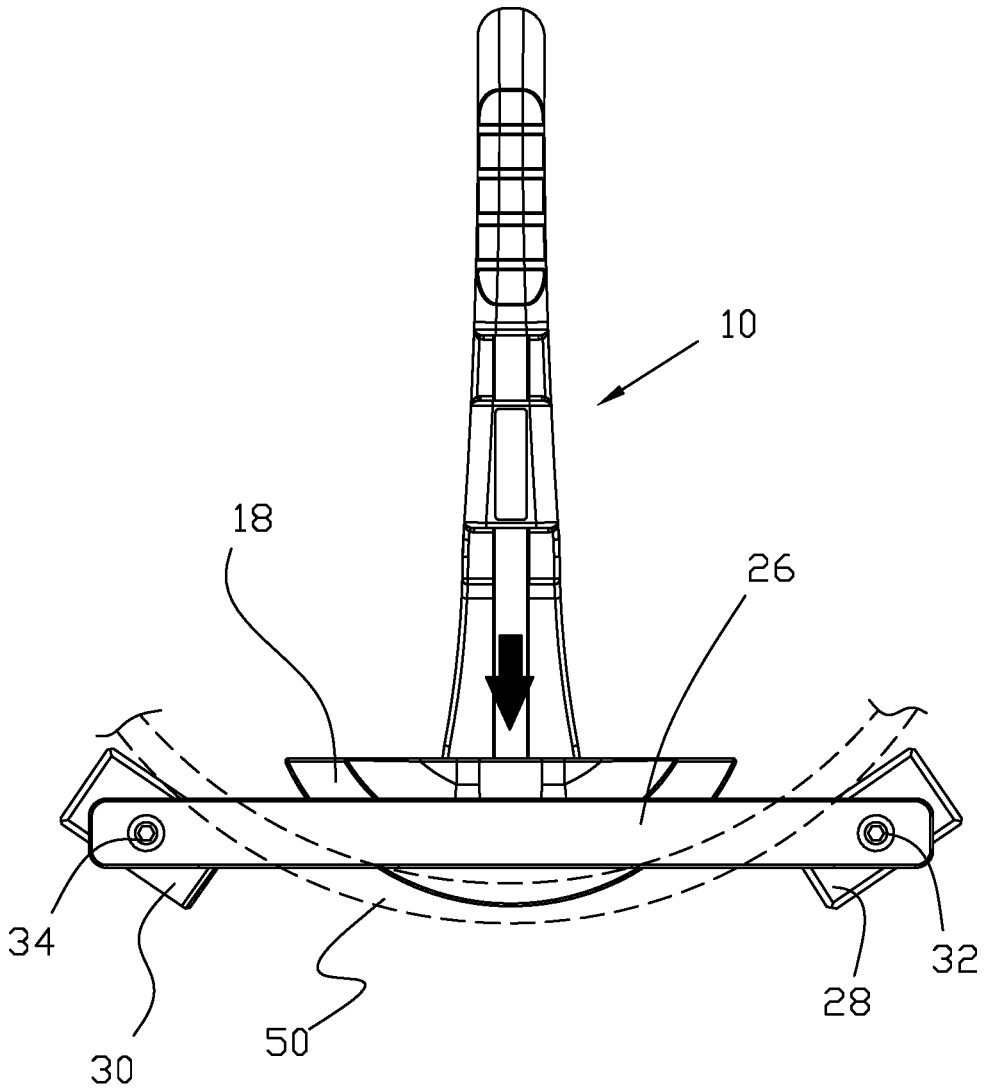
Figure 7:
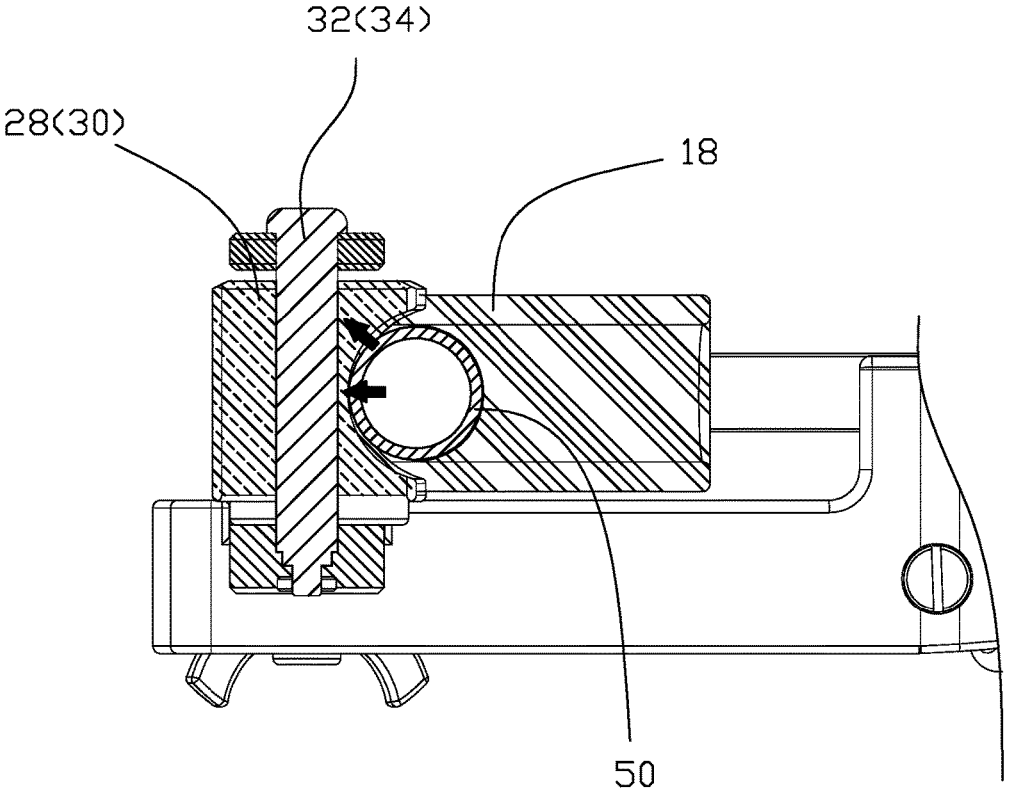
FIG. 7 is a sectional view of the first preferred embodiment of the present invention, showing the block and the pin.

As shown in FIG. 6 and FIG. 7, the tube 50 is bent by the arched member 18 and the first and the second blocks 28 and 30, so that the first and the second blocks 28 and 30 will be rotated, and the first and the second pins 32 and 34 take a pressure from the tube 50.

Since the first and the second pins 32 and 34 have their opposite ends connected to the first and the second plate 24 and 26, which provide the first and the second blocks 28 and 30 with strong structures, the first and the second blocks 28 and 30 are able to take large stress from the tube 50. As a result, the first and the second pins 32 and 34 will not be bent when the tube bender of the present invention is applied to bend the tube 50, and the tube 50 will be precisely bent with a preset curvature. Furthermore, the tube bender of the present invention will have a long product's life.

Figure 8:
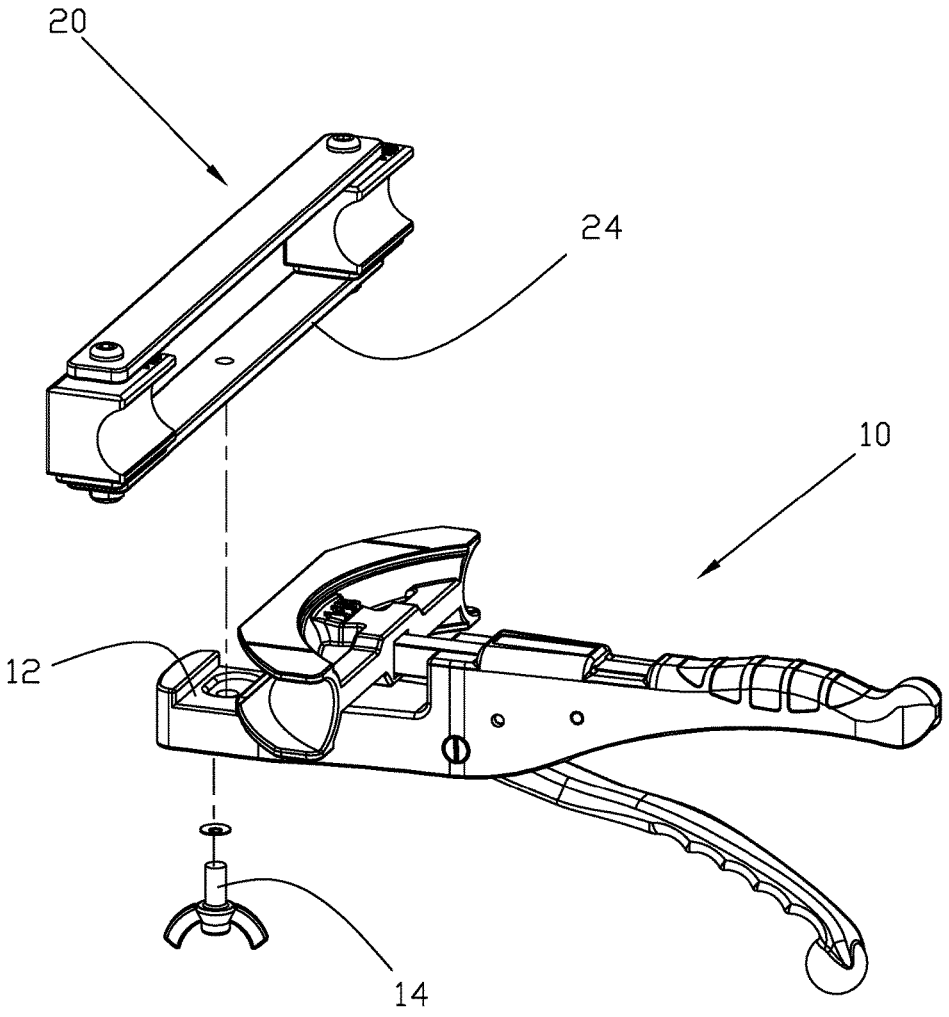
FIG. 8 is an exploded view of a second preferred embodiment of the present invention.
Figure 9:
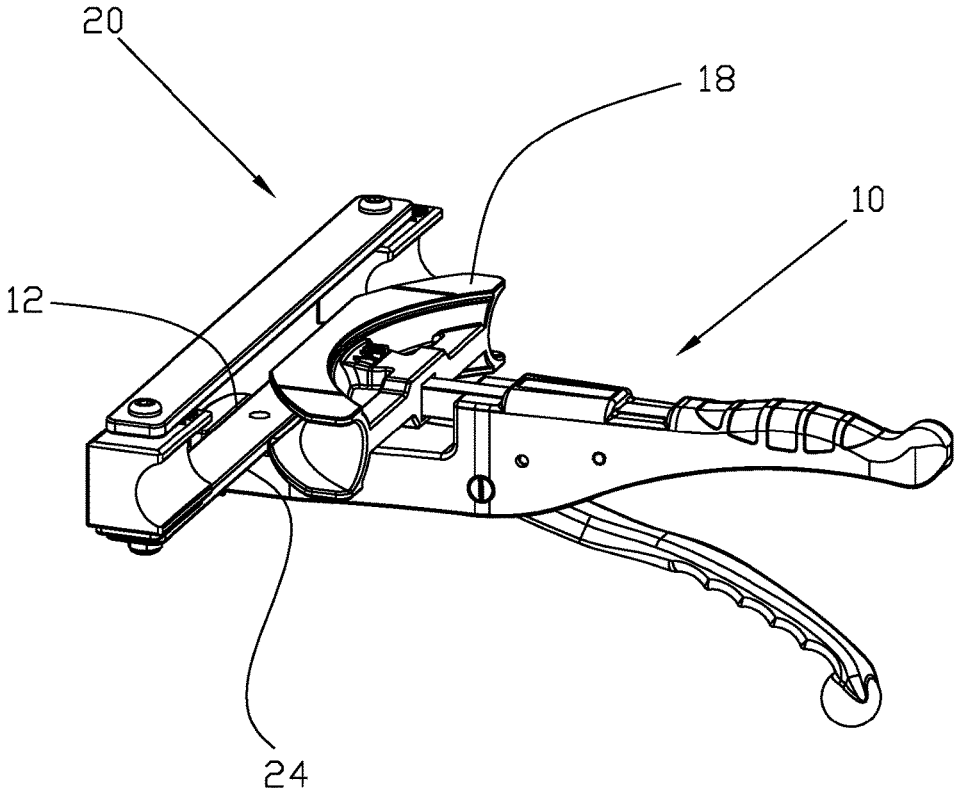
FIG. 9 is a perspective view of the second preferred embodiment of the present invention.

FIG. 8 and FIG. 9 show a tube bender of the second preferred embodiment of the present invention, which is the same as the first preferred embodiment, except that the bottom of the first plate 24 of the bending base 20 is flat, which means that no slot is provided on the first plate 24. The first plate 24 engages the first slot 12 of the bending tool 10, and the positioning member 14 is applied to firmly connect the bending tool 10 to the bending base 20.

It must be pointed out that the embodiments described above are only some preferred embodiments of the present invention. All equivalent structures which employ the concepts disclosed in this specification and the appended claims should fall within the scope of the present invention.

What is claimed is:

1. A bending base of a tube bender, which is connected to a bending tool of the tube bender, comprising:

a first plate;

a second plate kept a predetermined distance from the first plate to form a bending space therebetween;

a first block, which has a first groove, received in the bending space and pivoted on the first plate and the second plate for free rotation; and a second block, which has a second groove, received in the bending space and pivoted on the first plate and the second plate for free rotation;

wherein the first block and the second block are between the first plate and the second plate, and have opposite ends thereof pivoted on the first plate and the second plate respectively;

wherein the first plate and the second plate are two elongated plates; the second plate is provided with a first slot, and the bending tool is provided with a second slot; the bending base is connected to the bending tool with the first slot engaging the second slot.

2. The bending base of the tube bender of claim 1, further comprising a positioning member inserted into the first plate and the bending tool at a position where the first slot engages the second slot to connect the bending base to the bending tool.

* * * * *